US010913631B2

(12) United States Patent
Meyerhans et al.

(10) Patent No.: US 10,913,631 B2
(45) Date of Patent: Feb. 9, 2021

(54) APPARATUS AND METHOD FOR CUTTING OR PERFORATING A PAPER WEB

(71) Applicant: MÜLLER MARTINI HOLDING AG, Hergiswil (CH)

(72) Inventors: Rolf Meyerhans, Reiden (CH); Roger Lüscher, Lucerne (CH); Markus Bracher, Pfaffnau (CH)

(73) Assignee: MÜLLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 16/200,958

(22) Filed: Nov. 27, 2018

(65) Prior Publication Data

US 2019/0161312 A1 May 30, 2019

(30) Foreign Application Priority Data

Nov. 30, 2017 (CH) ..... 1464/17

(51) Int. Cl.
*B65H 35/00* (2006.01)
*B41J 11/70* (2006.01)
(Continued)

(52) U.S. Cl.
CPC ..... *B65H 35/0086* (2013.01); *B26D 1/405* (2013.01); *B26D 3/085* (2013.01);
(Continued)

(58) Field of Classification Search
CPC .... B65H 35/0086; B65H 35/04; B65H 35/08; B65H 35/10; Y10T 83/7738;
(Continued)

(56) References Cited

U.S. PATENT DOCUMENTS 1,738,353 A * 12/1929 Cameron ..... B23D 35/008 83/408
3,552,251 A * 1/1971 Neff ..... B26D 5/32 83/299
(Continued)

FOREIGN PATENT DOCUMENTS

EP 1186561 A1 3/2002
EP 1394091 A1 3/2004
(Continued)

OTHER PUBLICATIONS

ETEL Motion Technology, retreived from https://www.etel.ch/torque-nnotors/direct-drive/ on Mar. 9, 2020 (Year: 2013).*
(Continued)

*Primary Examiner* — Evan H MacFarlane
(74) *Attorney, Agent, or Firm* — FisherBroyles, LLP; Robert Kinberg

(57) ABSTRACT

An apparatus and a method for processing a digitally printed-on paper web, conveyed continuously through the apparatus includes a perforating tool for perforating the paper web transverse to its movement direction, and a cutting tool for cutting print sheets from a downstream end of the paper web. The tools are attached spaced-apart to a tool carrier which can be moved to two operating positions in which respectively one of the tools can be made to engage with a counter tool on a rotating cutting drum.

20 Claims, 7 Drawing Sheets

(51) Int. Cl.

| | |
|---|---|
| ***B65H 35/10*** | (2006.01) |
| ***B26D 1/40*** | (2006.01) |
| ***B26D 3/08*** | (2006.01) |
| ***B26D 9/00*** | (2006.01) |
| ***B26D 5/14*** | (2006.01) |
| ***B26F 1/20*** | (2006.01) |
| ***B42C 19/06*** | (2006.01) |
| ***B41F 19/00*** | (2006.01) |
| *B42C 9/00* | (2006.01) |
| *B26D 7/26* | (2006.01) |

(52) U.S. Cl.
CPC ..... *B26D 5/14* (2013.01); *B26D 9/00* (2013.01); *B26F 1/20* (2013.01); *B41F 19/008* (2013.01); *B41J 11/70* (2013.01); *B42C 19/06* (2013.01); *B65H 35/10* (2013.01); *B26D 2007/2692* (2013.01); *B42C 9/0006* (2013.01)

(58) Field of Classification Search
CPC ... Y10T 83/7743; Y10T 83/4847; B26D 1/38; B26D 1/385; B26D 9/00; B26D 1/40; B26D 1/405; B26D 3/085; B26D 5/14; B26D 5/16; B26D 5/18; B26F 1/20; B41F 19/008; B41J 11/70; B42C 19/06
USPC ..... 83/479, 480, 349
See application file for complete search history.

(56) References Cited

U.S. PATENT DOCUMENTS 3,733,949 A * 5/1973 Bradley ..... B23Q 11/0078 83/349
3,750,510 A * 8/1973 Gabriels ..... B26D 1/385 83/305
4,079,646 A * 3/1978 Morishita ..... B26D 1/626 83/349
4,114,491 A * 9/1978 Hashimoto ..... B26D 1/385 83/341
5,344,091 A * 9/1994 Molison ..... B26D 1/385 242/527.1
10,005,197 B2 * 6/2018 Kien ..... B26F 1/14
2005/0077171 A1 * 4/2005 Hagemann ..... B65H 5/004 204/164
2006/0266179 A1 * 11/2006 Yamashita ..... B26D 7/2628 83/130
2009/0320663 A1 * 12/2009 Yamamoto ..... A61F 13/15723 83/100
2012/0245011 A1 * 9/2012 De Matteis ..... B26D 1/0006 493/360
2013/0120555 A1 * 5/2013 Bigari ..... B26D 5/34 348/88

FOREIGN PATENT DOCUMENTS

EP 1484145 A2 12/2004
EP 1818299 A1 * 8/2007 ..... B65H 35/08
EP 2818331 A2 12/2014
JP H04-66478 A 3/1992

OTHER PUBLICATIONS

Internet Archieve record of ETEL Motion Technology showing Jun. 18, 2013 publication date, retreived from https://web.archive.org/web/20130618212408/https://www.etel.ch/torque-motors/direct-drive/ on Mar. 9, 2020 (Year: 2020).*
International Search Report for Swiss Patent Application No. 14642017 dated Apr. 4, 2018 (with English translation).

* cited by examiner

APPARATUS AND METHOD FOR CUTTING OR PERFORATING A PAPER WEB

CROSS-REFERENCE TO RELATED APPLICATIONS

This application claims priority to Swiss Application No. 01464/17 filed Nov. 30, 2017, the disclosure of which is incorporated herein by reference in its entirety.

BACKGROUND OF INVENTION

The invention relates to an apparatus and a method for processing a digitally printed paper web, conveyed continuously through the apparatus, using a perforating tool for perforating the paper web transverse to the movement direction and a cutting tool for cutting off print sheets from a downstream end of the paper web, which tools are respectively arranged on a first side of the paper web and transverse or nearly transverse to the movement direction of the paper web, as well as at least one counter tool arranged on a paper web side opposite the first side.

European patent document EP2818331 A2 discloses a generic apparatus and method for cutting or perforating a digitally printed paper web, provided with a perforating and cutting station and transverse and longitudinal folding devices for further processing print sheets having different numbers of pages. The perforating and cutting station which cuts and/or perforates the paper web transverse to its movement direction is composed of two processing stations, arranged along the paper web, a perforation station and a cutting station. A perforating device of this type is described, for example, further in European patent application EP1484145 A2. It comprises a constantly rotating, hardened steel cylinder and a perforating tool that cooperates with the steel cylinder and rotates intermittently around an axis. The cutting device according to EP2818331 A2 comprises a cutting tool embodied as guillotine-like blade, by means of which the paper web can be cut over the complete width. During the cutting, the paper web is stopped briefly. A compensating mechanism arranged between the perforating device and the cutting device, at which location the paper web is deflected around several rollers, functions to compensate for the speed differences between the perforating device and the cutting device that develop as a result of the stopping and accelerating. Following the perforating and the cutting, the print sheets cut from the paper web can be folded longitudinally once or several times transverse to the movement direction before being stacked to form a book block and being transported away. With this apparatus, it is possible to cut or perforate a conveyed paper web, but the costs, space requirement and control expenditure for this apparatus are high because of the number of processing stations. Owing to the acceleration and delay operations for the cutting, the paper speed and number of cutting operations per time unit are limited, which is known to one skilled in the art. The costs are further increased by the compensating device arranged between the perforating and cutting devices.

The term "perforating" is understood in the prior art and for this application to refer to a partial cutting through, partial separating or deforming, such as the squeezing of the paper web at a location where the paper will be folded later on. The term "cutting" is understood to mean a complete separating of the paper web. With a traditionally printed paper web where the print image repeats corresponding to the circumference of the print cylinder, identical print sheets of a first type are produced. Following a conversion, print sheets of a second, third type etc. are produced respectively. A book, or section of a book, and a brochure or newspaper, are generated by collating several print sheets which differ. Prior to the collating, the different print sheets are respectively separated from a stack of the same and jointly produced print sheets. In contrast, with a digitally printed paper web whole books or book sections are printed sequentially onto the paper web. The sequentially printed-on sheets can have different page number and form a book or a section of a book following the cutting, folding and stacking.

An apparatus for feeding individual sheets to a printer, which apparatus is provided with a device for cutting off individual sheets from a paper web that moves along periodically in a conveying device is disclosed in European patent application EP1394091 A1. The individual sheets are cut with a cutting drum provided with a cutting tool, arranged transverse to the conveying device and rotating around an axis, and are then supplied to the printing press with a conveying device. For the cutting operation, the cutting drum is driven by a motor via a toothed belt. The rotating cutting tool here operates jointly with a locally fixed counter blade arranged on the other side of the paper web. Following the cutting of a single sheet, the paper web and the cutting drum are stopped and are then accelerated again for the next cutting operation. This apparatus for cutting off individual pages of different lengths cannot be used to perforate the paper web. The apparatus furthermore operates relatively slow because the paper web must first be stopped and then accelerated once more.

A different apparatus for cutting a paper web is disclosed in European application EP1186561 A1, which is provided with a rotating cutting cylinder, having a cutting tool and a perforating tool. The tools embodied as knives for this cutting cylinder cooperate with a fixed counter blade. The paper web which is guided through between the cutting cylinder and the locally fixed counter blade is successively cut or perforated along the circumference of the rotating cutting drum, depending on the arrangement of the cutting and perforating tools. The paper web is processed with the scissor-cut principle where no sudden processing over the complete width of the paper web takes place, but where only a section of the cutting knife engages with the counter blade. During the cutting, the cutting region moves from one edge of the paper web to the other. To achieve a desired scissor cut that is advantageous with respect to cutting quality, service life for the cutting tools and quiet running time, the cutting drum is positioned at an acute angle, relative to the counter tool, in the plane for the paper web and opposite the counter tool. For cutting print sheets having a different format from the paper web or if the perforation should be located at a different location on the print sheet, the position of the cutting and/or perforating tool on the cutting drum must be changed. Alternatively, the cutting drum can also be replaced by a different cutting drum with correspondingly attached cutting and perforating tools. Adapting the spacing from cut to cut, from cut to perforation and from one type of perforation to another, as well as changing the sequence of the cutting and perforating operations, is only possible when the machine is stopped and using a manual intervention.

SUMMARY OF THE INVENTION

It is an object of the present invention to create a method and an apparatus with which a digitally printed and continuously conveyed paper web can optionally be perforated or cut during the operation, even at high speeds and with changeable spacing. The apparatus should furthermore be designed so that it can be realized easily and space-saving and thus also cost-effective.

The above and other objects are achieved by providing, according to one embodiment of the invention, an apparatus for processing a paper web, digitally printed-on and moved continuously through the apparatus in a movement direction, the apparatus comprising: a perforating tool for perforating the paper web transverse to the movement direction; a cutting tool for cutting off print sheets from a downstream end of the paper web, wherein the perforating tool and the cutting tool are respectively arranged on a first side of the paper web and transverse or nearly transverse to the movement direction of the paper web, at least one counter tool arranged on a side that is opposite the first side of the paper web; a rotatable cutting drum for holding the at least one counter tool, the drum including a rotational axis oriented transverse or nearly transverse to the movement direction of the paper web; and a joint tool carrier for accommodating the perforating tool and the cutting tool, wherein the perforating tool and the cutting tool are attached spaced-apart on the tool carrier, and wherein the tool carrier is movable to two operating positions by a swivel movement in which respectively the perforating tool or the cutting tool is made to engage with the at least one counter tool for processing the paper web.

Thus, in a single, compact processing station, none or one or several perforations can be realized optionally and successively on a continuously conveyed paper web with digitally printed-on sheets and print sheets can be cut off with a cutting tool from the paper web. Continuous transport here is understood to refer to an uninterrupted transport at constant or nearly constant speed. In contrast, a transport where the paper web must be stopped or nearly stopped repeatedly during the processing is not a continuous transport within the meaning of this application. The spacing between the processing operations on the paper web, using the perforating or cutting tool, and the sequence of the processing operations can be adapted continuously to the sheets printed onto the paper web. In the process, the print sheets can differ as to format and the number of pages, or the number of transverse perforations along which the print sheets are folded transverse downstream of the inventive apparatus.

According to a modified embodiment of the invention, the tool carrier is arranged on a swivel axis, so that it can swivel at an angle between two operating positions, and is oriented transverse or nearly transverse to the movement direction T for the paper web and parallel to a transport plane for the paper web, so that the perforating tool or the cutting tool can engage with the at least one counter tool. Owing to the movement of swiveling around a relatively small angle during a change between operating positions, the tools travel only a minimum distance with slight change in height. The swiveling angle preferably is in the range between 5° and 90° and even more preferred in the range between 15° and 30°. The change in height for the tools has the advantage that the tools are arranged at a distance to the paper web if they are not in the operating position. Furthermore, less weight is accelerated and slowed down again because of the swivel movement, than if the complete tool carrier would have to be moved in linear direction between two operating positions. Thanks to the small distance which the tools must travel over the swiveling angle, the change from one to the other processing station can occur quickly and during the course of the operation. In addition, the positioning of the tools can be rigid, simple, cost-effective and space saving.

In one embodiment, the rotational axis for the cutting drum and the swivel axis for the tool carrier are arranged at an acute angle, relative to each other, in a plane that is parallel to the transport plane for the paper web, so that according to the scissor-cutting principle used, a blade of the perforating tool or a blade of the cutting tool respectively can be brought in contact with the counter tool over a partial region of its length. The cutting range thus moves during the processing from one edge of the paper web and transverse to the movement direction to the other paper edge. Since the perforating or the cutting do not occur suddenly over the complete width of the paper web, the forces generated during the processing and the noise emission can be clearly reduced while, at the same time, the service life and the cutting quality for the cutting tools is increased through the scissor-type cut.

In another embodiment, the tool carrier is connected via a crankshaft to a drive axis of a first drive motor for realizing the swivel movement. In particular, the crankshaft comprises a push rod that is connected via a first axis to a crank arranged on the drive axis of the first drive motor. Furthermore, the crankshaft is connected via a second axis to the tool carrier. With the crankshaft, the rotational movement of the first drive motor can easily and cost-effectively be converted to a swivel movement of the tool carrier, without the first drive motor having to stop at one of the operating locations and having to change the rotational position. Owing to the crankshaft, a slight deviation of the rotational position of the first drive motor in both dead-center positions of the tool carrier hardly affects the position for processing the paper web. The first drive motor can be arranged upstream or downstream of the swivel axis for the tool carrier.

According to a modified embodiment, the first drive motor is embodied as a gearless torque motor. Despite high rotational moments, torque motors have a small structural size even at low speed and gears are not needed, thus resulting in a compact and cost-effective drive with no play.

According to another advantageous embodiment of the apparatus, a first axis and second axis of the crankshaft, and the drive axis of the first drive motor are positioned parallel to each other. The first axis and the drive axis are arranged spaced-apart by a crank radius. Owing to the parallel axes, the bearing locations in the push rod and the crank can be realized easily and cost-effectively because hardly any axially effective forces are generated, but force flows directly from the tool carrier to the machine frame. The length of the crank radius influences the swivel angle of the tool carrier.

It is furthermore advantageous if the first axis, the second axis and the drive axis for the first drive motor respectively are positioned in a plane if the tool carrier is located in one of the two operating positions. As a result, the cutting forces generated during the processing of the paper web are transmitted from the cutting and perforating tools via the tool carrier, the push rod and the crank directly to the machine frame, without an interfering rotational moment being transmitted to the drive axis of the first drive motor. The first drive motor can thus be dimensioned smaller which results in a cost saving.

According to a different modification of the invention, the tool carrier must be moved to a rest position between the two processing locations in which neither the perforating tool nor the cutting tool engages with the counter tool. When setting up a machine, it is advantageous if the paper web can be guided through all processing stations without being perforated or without sheets being cut from its end. Furthermore, very long sheets or cutting lengths can also be generated in the rest position since the cutting drum can rotate further and another cut can be determined only once the knife carrier is swiveled from the rest position to an operating position.

According to a different embodiment of the invention, the cutting drum with the at least one counter tool is driven with the aid of a second drive motor, wherein the second drive motor is connected to a drive control for regulating its speed and angle position. In this way, sheets having different lengths can easily be cut from the downstream end of the paper web and perforations realized at optional locations. The connection to a drive control ensures a precise control of the position and speed of the cutting drum.

It is furthermore advantageous if the first drive motor for the tool carrier and a third drive motor for a drive mechanism for the paper web transport are also connected to the drive control, thus ensuring that these two drive motors also can be precisely activated for controlling their position and/or rotational angle and the rotational speed. Individual changes and/or corrections of their rotational position and the rotational speed can furthermore also be made easily via the drive control, taking into consideration the movement profiles of the other drives connected to the drive control.

According to another embodiment, a sensor is arranged upstream of the cutting drum, which sensor detects an identification mark affixed to the paper web. In this way, information relating to the current position of the sheets printed onto the paper web and/or the type of processing for the paper web can easily be transmitted to the drive control, or information relating to the processing of the print sheets can be called up from a super-imposed control based on the identification mark.

According to yet another embodiment of the apparatus, the cutting drum, the tool carrier and the first drive motor are positioned inside a joint machine frame. The precise orientation of the rotational axis for the cutting drum, relative to the swivel axis of the tool carrier, as well as the precise arrangement of the crankshaft and the first drive motor can thus be secured. The joint machine frame furthermore allows assembling and adjusting the listed components outside of the movement space of the paper web and the cut print sheets. The joint machine frame also makes it easier to adjust the perforating tool and the cutting tool which both cooperate with at least one counter tool.

According to yet another embodiment, the machine frame is provided with an adjustment device that is swivels relative to the paper web around fulcrum, parallel to the transport plane for the paper web. For changes in the length of the pages printed onto the paper web, or for changes in the time interval between two processing operations for the perforation or cut, respectively, the position of the tools arranged in the machine frame must be adapted because of the scissor-cutting principle, so that the processing operations occur perpendicular to the movement direction of the paper web and/or perpendicular to the edges of the paper web. With the adjustment device, the change in the position of the machine frame around its fulcrum can be realized easily and quickly. The adjustment device advantageously comprises an adjustment motor, connected to the drive control and/or to a super-imposed control, as well as an adjustment spindle that is drive-connected to the adjustment motor.

According to a further aspect of the invention, there is provided a method for which the at least one counter tool rotates around a rotational axis, oriented transverse or nearly transverse to the paper web movement direction, and for which the tool carrier, which accommodates the perforating tool and the cutting tool, is optionally moved to one of two operating positions for processing the paper web, thus allowing the perforating tool or the cutting tool to operate jointly with the at least one counter tool for perforating the paper web transverse to its movement direction or for cutting off print sheets at a downstream end of the paper web. In a single processing station, none or one or several perforations can therefore optionally be realized successively on digitally printed-on and continuously conveyed print sheets and print sheets can be cut from the paper web with the cutting tool. The spacing between the processing operations on the paper web, using the perforating or the cutting tool, as well as the sequence of the processing operations (i.e. perforating or cutting), can be adapted continuously to the sheets printed on the paper web. The print sheets can differ in format and number of pages, respectively the number of transverse perforations, along which the print sheets are folded in transverse direction downstream of the inventive apparatus.

According to one embodiment of the method, the tool carrier swivels back and forth around an axis by a swiveling angle between two operating positions, in transverse or nearly transverse direction to the movement direction of the paper web and parallel to a transport plane for the paper web. In the two operating positions in which the tool carrier stops, either the perforating tool or the cutting tool, respectively, engage with the at least one counter tool to perforate or cut the paper web, wherein this swiveling angle can be 20°. The angle may preferably range between 15° and 30° but should not be smaller than 5° and not larger than 90°. With the described method, for which a paper web is cut between a moving and/or rotating tool and a stationary tool, the cutting quality and the cutting precision are clearly higher as for a processing between two moving tools. The swivel movement of the tool carrier around the swivel axis easily and cost-effectively ensures that respectively one of the two tools attached to the tool carrier is in contact with the at least one counter tool of the cutting drum when in an operating position and that, simultaneously, the other tool is positioned at a distance to the paper web and the processing location.

According to a different advantageous embodiment of the method, the continuously transported paper web is alternately perforated with the perforating tool and cut with the cutting tool, wherein the first drive motor connected via a crankshaft to the tool carrier rotates with a constant or nearly constant speed. Especially at high speeds, smaller bearing forces and less vibrations occur during a stop and start-up operation because of the continuous or nearly continuous operation of the tool carrier. The mass inertia of the first drive motor and the crankshaft function in the manner of a fly wheel in both dead-center positions of the tool carrier, which correspond to the operating positions, and help accelerate the tool carrier once more following the brief standstill.

The tool carrier according to another embodiment remains in the respective operating position and the first drive motor is stopped if several successively following and uniform processing operations of the paper web are realized. The first drive motor starts rotating once more when the tool carrier is moved from one to the other operating position, following several successive processing operations of the same type. Thus, the tool carrier must be moved only if the paper web is to be processed successively with a different tool. For example, if the web comprising print sheets with two pages is only cut but not perforated, the first drive motor, the crankshaft and the knife carrier with the tools are stopped. The components are thus protected, and it is prevented that the paper web or the sheets cut from this web are damaged by the unnecessary swiveling back and forth of the perforating and cutting tool or that the transport is interrupted.

According to a different embodiment of the method, a drive motor for the paper web transport, a second drive motor for a cutting drum that accommodates the counter tool, and the first drive motor for the tool carrier are activated by a drive control. This drive control can react immediately to format changes in the print sheets or if problem sizes occur and can control the drives in such a way as to ensure the precise positioning of the paper web, the cutting and perforating tools, and the at least one counter tool, which is necessary for a high cutting quality.

In a further embodiment, the signals from a sensor focused onto the paper web are evaluated in the drive control and the evaluation of the signals influences the activation of the drive motors. The precision of the perforation and/or the cut on the paper web at the predetermined locations can be increased with the signal from the sensor which detects the actual position of the paper web and the pages printed thereon. Deviations in the position of the paper web in movement direction, caused by slippage or expansion, can be reduced considerably with this embodiment.

According to another favorable embodiment, at least the perforating tool, the cutting tool and the counter tool are swiveled jointly, relative to the paper web, by an adjustment angle, parallel to the transport plane of the paper web. The paper web can thus be optionally perforated and cut at a right angle to its movement direction, even with differing lengths for the pages printed onto the paper web and/or for paper webs with differing widths. As a result of the swiveling during the standstill, but also while the apparatus is operational, paper webs with different widths and print sheets with different formats can be produced with the advantageous scissor cutting principle.

Additional advantageous features will be appreciated from the following description and accompanying drawings

BRIEF DESCRIPTION OF THE DRAWINGS

In the following, the invention is described in further detail, showing in.

DETAILED DESCRIPTION OF THE INVENTION

Figure 1:
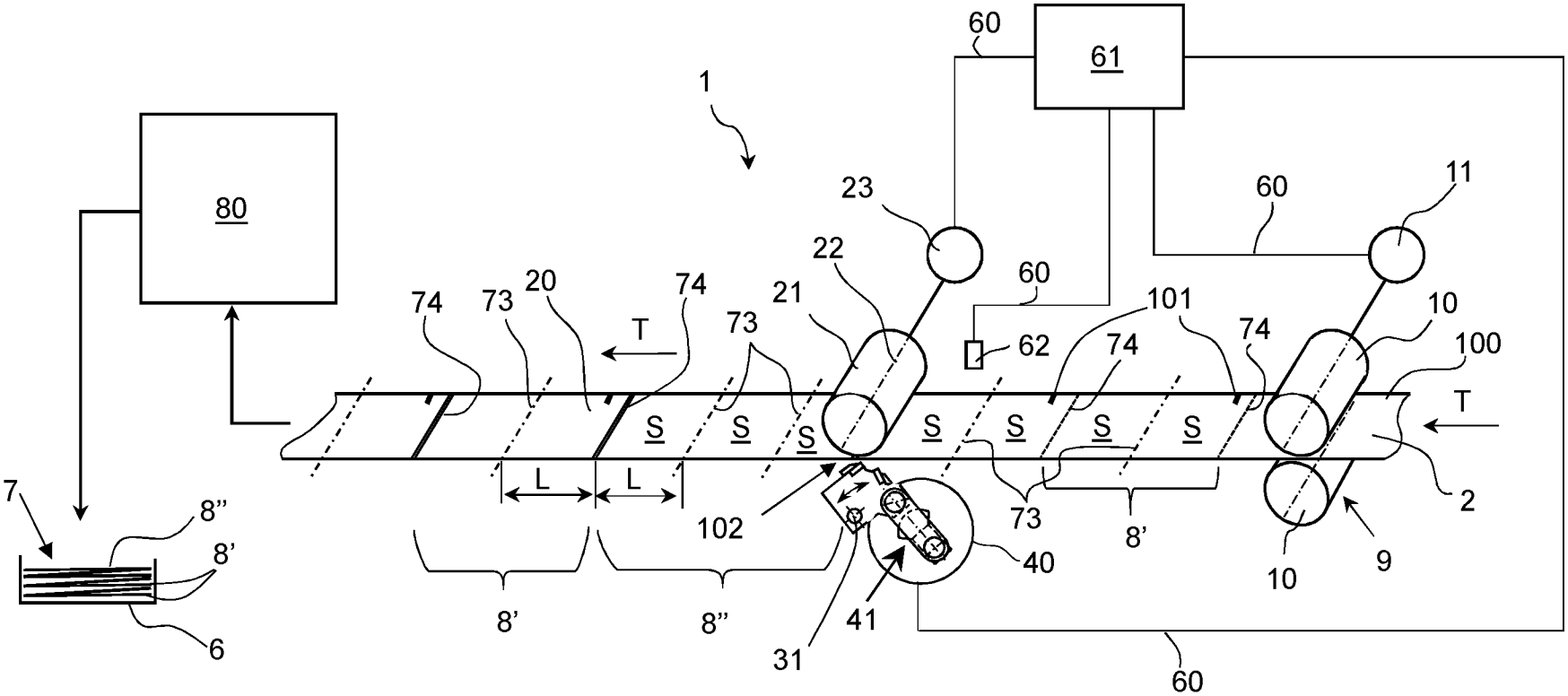
FIG. 1 A schematic representation of an apparatus for the optional perforating or cutting of a paper web corresponding to the invention.

FIG. 1 schematically shows an apparatus 1 for perforating and cutting a paper web 2, transported continuously in moving direction T. The paper web 2 is printed-on in upstream direction of the inventive apparatus 1 with the aid of a digital printing press, not shown herein, and can optionally be folded once or several times in a longitudinal folding device shown schematically in FIG. 6, so that the paper web 2 has one or several layers in the region of the apparatus 1. Print sheets 8' with four pages and print sheets 8" with six pages are printed successively onto the single-layer paper web 2, shown in FIG. 1, wherein FIG. 1 only shows the upper pages S. The pages S have a length L which can vary from page S to page S. The paper web 2 is driven by at least one drive mechanism 9, arranged upstream of the apparatus 1 for perforating and cutting the paper web 2. The drive mechanism comprises a single drive roller 10 or a pair of drive rollers 10 between which the paper web is driven frictionally adhering. The drive rollers 10 are connected to a drive motor 11 (hereafter designated the third drive motor 11). Downstream of the apparatus 1 for perforating and cutting the paper web 2, a transport device 70 (shown in FIG. 2) is arranged which takes over one end 102 of the paper web 2 or the cut paper sheets 8', 8" with its upper and lower transport elements 71, 72 and transports these further. The transport device 70 connects the apparatus 1 in downstream direction to one or optionally several sheet processing stations 80, shown only schematically in FIG. 1. One of the sheet processing stations 80 that is embodied, for example, as a transverse or longitudinal folding device, is followed by a stacking device 6 for forming a stack 7 with the print sheets 8', 8", cut from the end 102 of the paper web 2, wherein these sheets are either not folded, or folded once, or folded several times in transverse or longitudinal direction.

Figure 2:
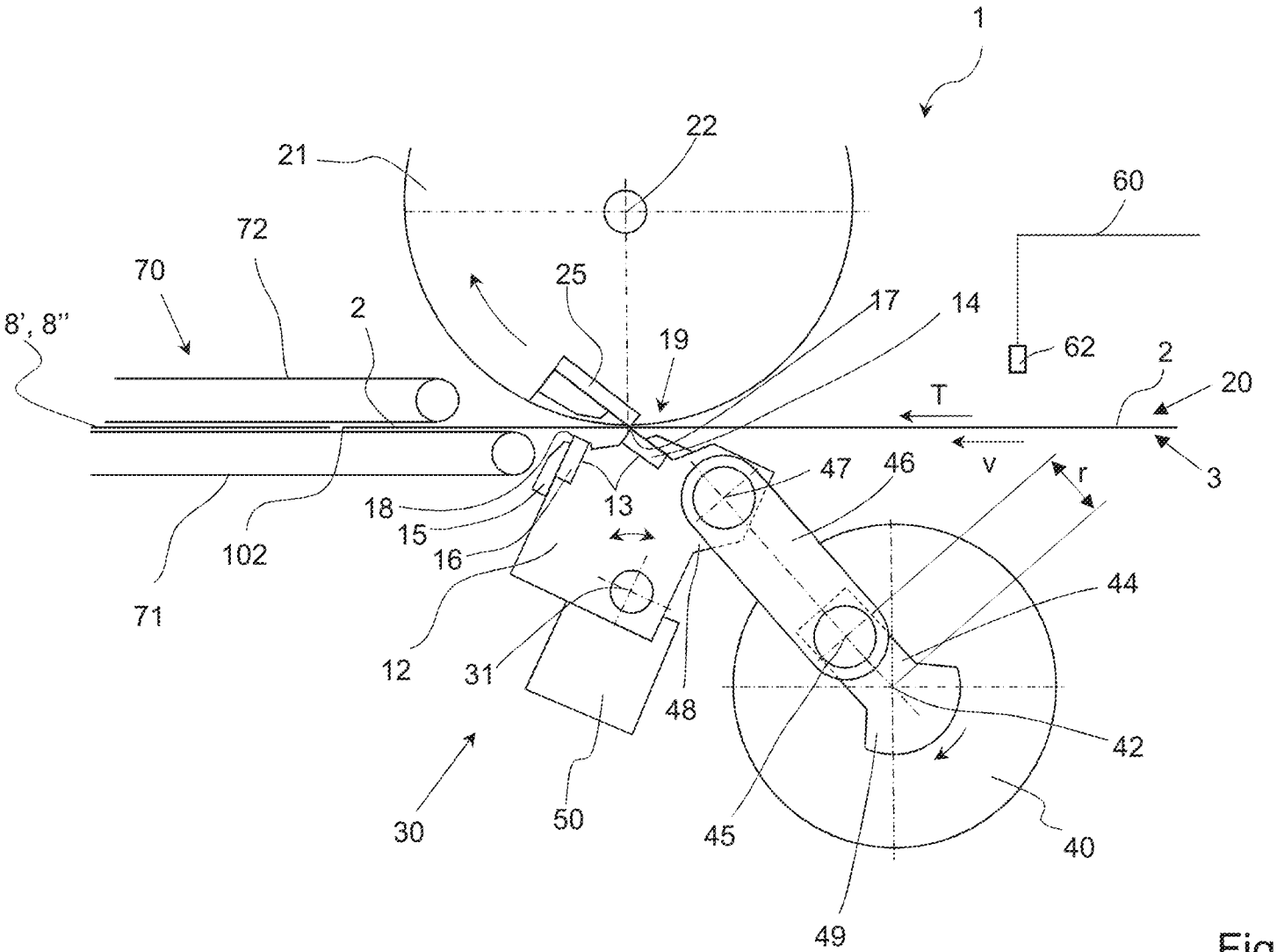
FIG. 2 A schematic view from the side of the inventive apparatus where the tool carrier is in a first operating position and a perforating tool is engaged with a counter blade.

The apparatus 1 as shown in FIG. 2 is provided on a first side 3 of the paper web 2 with a beam-type tool carrier 12, arranged transverse or nearly transverse to the movement direction T of the paper web 2. This tool carrier has two spaced-apart holding locations 13 where respectively one tool is attached. For the present embodiment, a perforating tool 14, also called a perforating knife, is attached on the right side with a fastening element 15 to the tool carrier 12. On the left side of the tool carrier 12, a cutting tool 16, also called a cutting knife, is attached with the aid of another fastening element 15. The cutting tool 16 can conceivably also be mounted on the right side and the perforating tool 14 on the left side. The perforating tool 14 is embodied as high-capacity knife with a blade 17 for which the blade 17 is interrupted at regular intervals. It is also conceivable that two or more perforating tools 14 are attached side-by-side over the length of the tool carrier 12 with one or several fastening elements 15. The cutting tool 16 can furthermore be embodied as high-capacity knife with a continuous blade 18, so that the paper web can be cut completely in a single processing operation. Of course, the cutting tool 16 can also consist of several cutting knives 16, arranged side-by-side in the holding locations 13. At least at the instant of cutting, the blades of the several cutting knives must be aligned with each other to obtain a straight cut in the paper web 2, perpendicular to the movement direction T. It is also conceivable that the perforating tool 14 and the cutting tool 16 are integrally formed or that the tool carrier 12 and the perforating and cutting tools 14, 16 are embodied as a single component. Further conceivable is that only one of the holding locations 13 of the tool carrier 12 is provided with a perforating tool 14 or a cutting tool 16 and that the other holding location remains empty during the operation.

Figure 3:
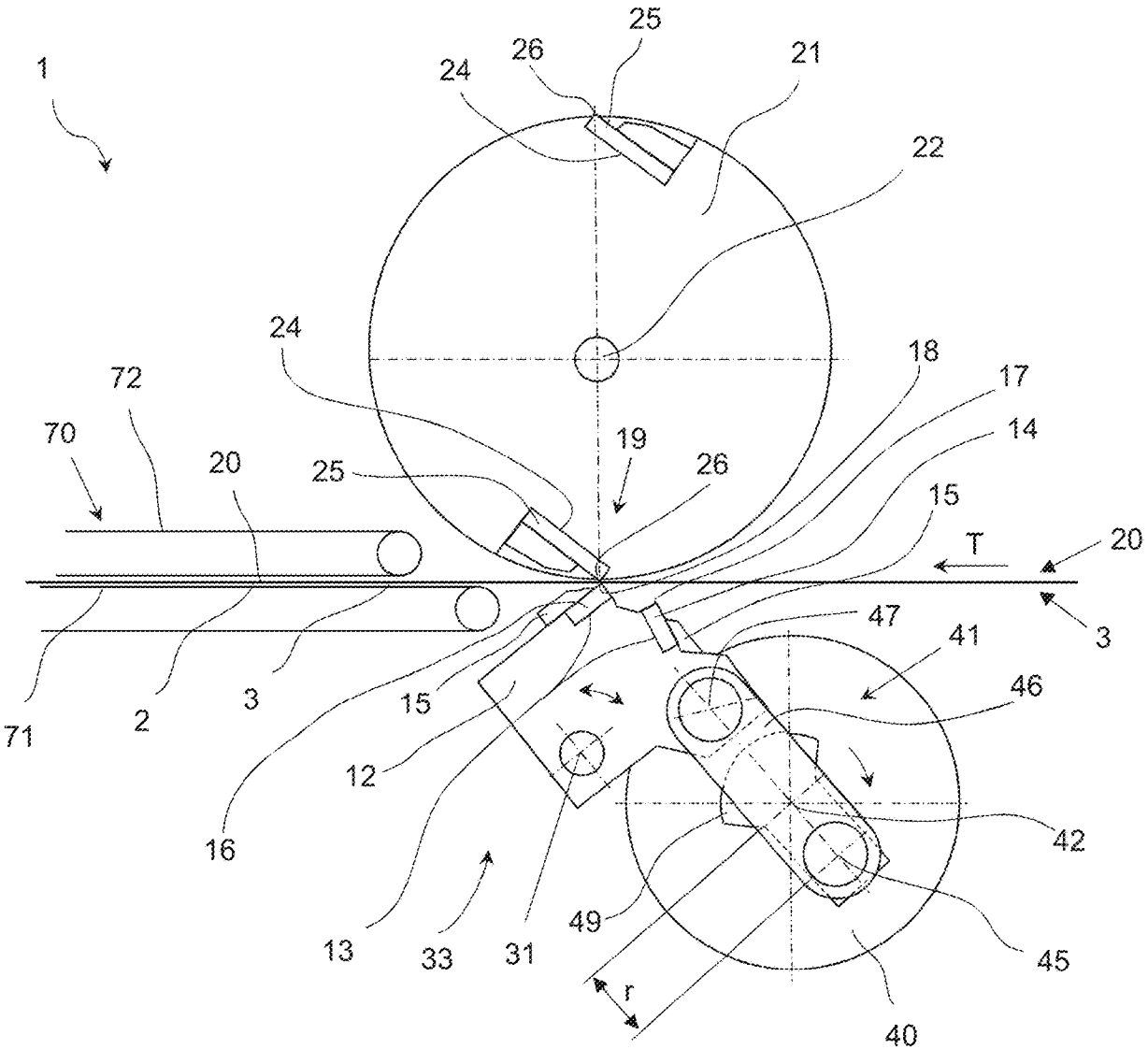
FIG. 3 A schematic view from the side, analogous to FIG. 2, for which the tool carrier is in a second operating position where the cutting blade cooperates with the counter blade.

A rotating cutting drum 21 is arranged on a second side 20, located opposite the first side 3, of the paper web 2 and opposite the tool carrier 12. The cutting drum 21 comprises a rotational axis 22 that is oriented transverse or nearly transverse to the movement direction T of the paper web and parallel to a transport plane 100 of the paper web 2. The cutting drum is driven in clockwise direction either directly, as shown schematically in FIG. 1, with a second drive motor 23 or via a belt drive that is not shown herein, and/or via a toothed gear, also not shown herein. As shown in FIG. 3, the cutting drum 21 is provided along its circumference with two holding locations 24, offset to each other by 180°, for holding one or several counter tools 25 with respectively one blade 26. The cutting drum 21, however, can also have only one or more than two holding locations 24 for counter tools 25. The circumference of the cutting drum with only one counter tool and/or the radian measure of the circumference of the cutting drum 21 between two blades 26 of adjacent counter tools 25 is selected such that for a maximum length L of the pages S, the circumferential speed of the cutting drum is the same or higher than the conveying speed v of the paper web. The cutting drum 21 is arranged relative to the paper web 2 in such a way that the circumference of the cutting drum 21, respectively an orbit of the blade 26 for the counter tool comes in contact tangentially or completely with the paper web 2.

Figure 4:
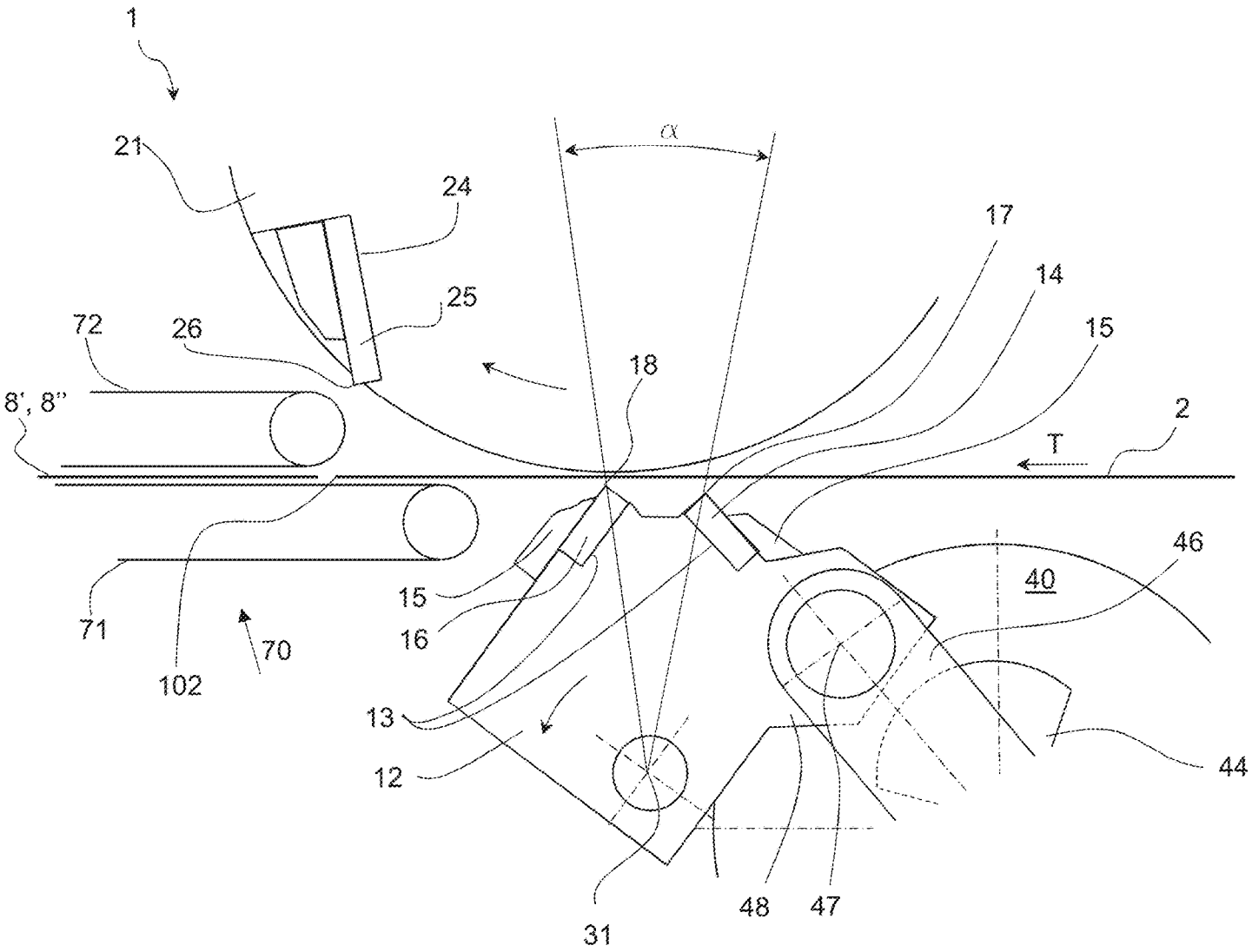
FIG. 4 A section of the view from the side, shown in FIG. 3, with the tool carrier in a resting position.

The tool carrier 12 has a first operating position 30, shown in FIG. 2, in which the perforating tool 14 in an operating position 19 engages with the rotating counter tool 25. The blade 18 of the cutting tool 16 in this operating position 30 is spaced-apart horizontally and vertically from the operating position 19. It would also be conceivable for the blade 18 of the cutting tool 16 to be spaced apart only horizontally or only vertically from the operating position 19. The tool carrier 12 can rotate around a swivel axis 31, arranged on the first side 3 of the paper web 2, either transverse or nearly transverse to the movement direction T of the paper web 2 and parallel to a transport plane 100 of the paper web 2, inside a machine frame 32 shown in FIG. 5. The tool carrier 12 is moved to a second operating position 33 as a result of swiveling by a swivel angle α around the axis 31, which is arranged on the tool carrier 12 side that is facing away from the paper web 2. The swivel angle given the reference a in FIG. 4 is approximately 20°. As previously mentioned, the swivel angle α can also be larger or smaller than 20°, for example ranging from 15° to 30°. However, the swivel angles can also be smaller and/or larger, but for geometric reasons these angles cannot be smaller than 5° and not larger than 90°.

A balancing weight 50 is attached to the tool carrier 12, as shown in FIG. 2. With this weight, the center of gravity for the tool carrier 12, including the perforating and cutting tools 14, 16 and the fastening elements 15, is displaced in the direction of the swivel axis 31. In the ideal case, the center of gravity is located on the swivel axis 31. The balancing weight 50 can, of course, also be formed directly onto the tool carrier 12, for example to simultaneously increase the rigidness of the tool carrier 12 with the balancing weight 50. High vibrations caused by the back and forth swiveling of the tool carrier 12 can thus be reduced through the balancing weight.

It is advantageous if the rotational axis 22 of the cutting drum 21 is arranged at an angle β, as shown in FIG. 7, relative to the swivel axis 31 of the knife carrier and thus also relative to the orientation of the blades 17, 18 belonging to the perforating tool 14 and the cutting tool 16. As a result, the paper web 2 is cut transverse to its transporting direction T with the aid of a scissor cut. The angle β should be selected smaller than 2°, advantageously smaller than 1°. Owing to the small angle offset, the paper web 2 is not simultaneously cut over the complete width B, but over a cutting region extending transverse to the paper web 2 where a segment of the blades 17, 18 engages in a segment of the blade 26 on the counter tool. This cutting principle is described in further detail in the EP1186561 A1.

In the second operating position 33, shown in FIG. 3, the cutting tool 16 in the operating position 19 engages with the rotating counter tool 25. As for the above-described position of the cutting tool 16 in the operating position 33, the blade 17 of the perforating tool 14 is arranged in horizontal and vertical direction at a distance from the operating position 19. If the tool carrier 12 of an alternative embodiment, not shown herein, were to be moved with a linear movement from one to another operating position, the blade 17 of the perforating tool 14 would be positioned only in the horizontal or vertical direction at a distance to the operating position 19, as for the above-described cutting tool 16 in the operating position 33. The blade 17 of the perforating tool 14, respectively the blade 18 of the cutting tool 16, are oriented for the cutting operation either transverse or nearly transverse to the movement direction T of the paper web 2. It is also conceivable that the tool carrier 12 is designed to be moved in linear direction along a movement path from one operating position to another. The operating position 19 is located for both operating positions 30, 33 where the cutting drum 21 is positioned tangentially closest to the paper web 2, in the area surrounding this position. The tool carrier 12 can also be moved to a rest position, not shown herein, between the two operating positions 30, 33. In this rest position, the two blades 17, 18 are positioned vertically and/or horizontally at a distance to the operating position 19 and do not come in contact with the paper web 2 on the first side 3.

Figure 5:
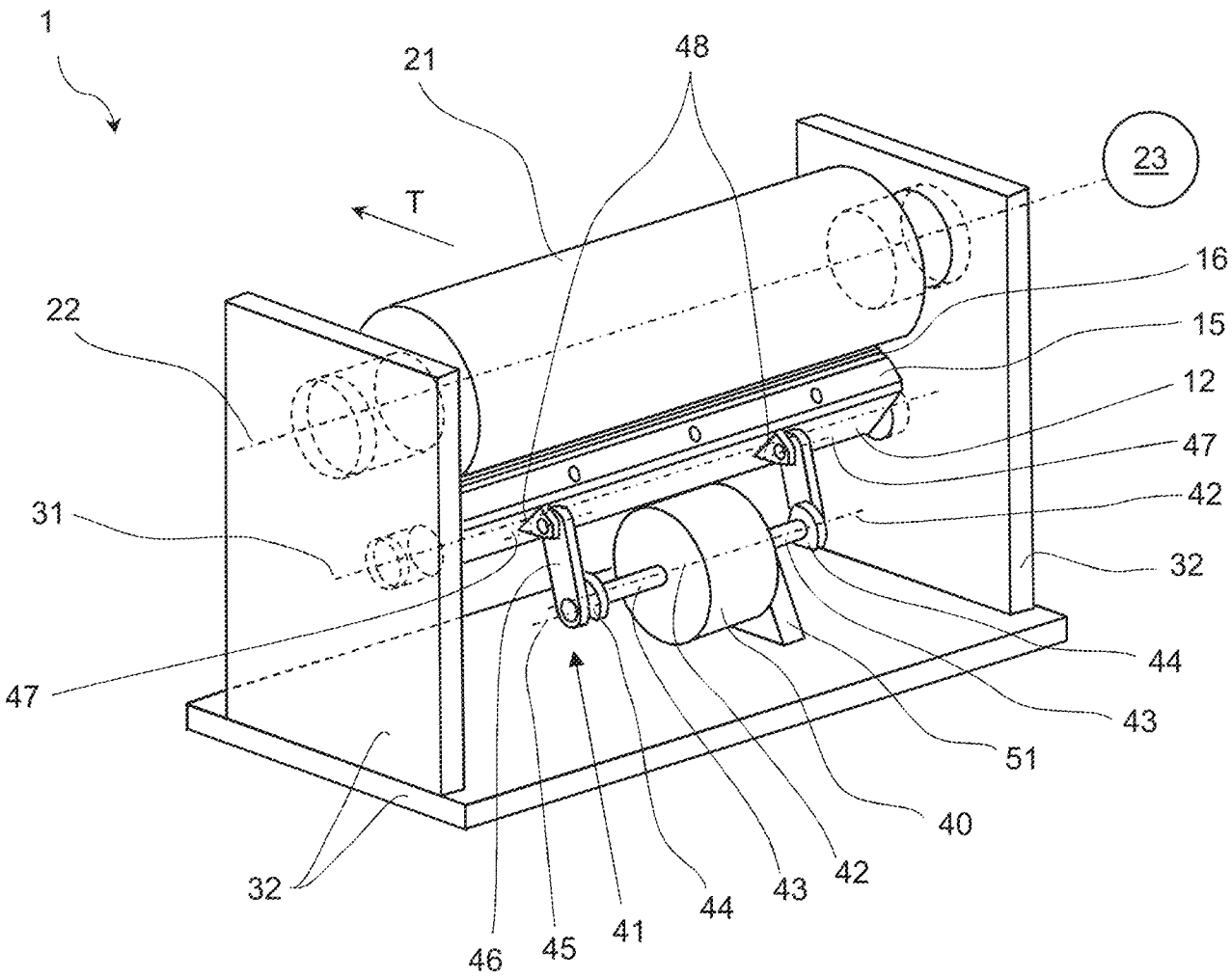
FIG. 5 A spatial representation of an apparatus for optionally perforating or cutting a paper web.

To realize the swiveling movement of the tool carrier 12 between the two operating positions 30, 33, a drive motor 40, hereafter designated the first drive motor 40, and at least one crankshaft 41 are provided as shown in FIGS. 1, 2, 3 and 5. The first drive motor 40, in particular embodied as torque motor without play, is affixed with a holding element 51 to the machine frame 32, on the first side 3 of the paper web 2 and upstream of the operating position 19. The first drive motor 40 comprises a drive axis 42 that is oriented parallel to the swivel axis 31 of the tool carrier 12. In addition, the first drive motor 40 comprises a continuous motor shaft 43 which extends on the two opposite sides of the first drive motor 40 in the direction of the drive axis 42 and away from the first drive motor. Described in the following is the drive connection on one side between one of the two ends of the motor shaft 43 and the tool carrier 12 via the crankshaft 41. As can be seen in FIG. 5, the configuration on one side corresponds to that on the other side. The motor shaft 43 can be supported on the machine frame for increasing the rigidness via one or several bearing locations, not shown herein.

A crank 44 is connected torque-proof to the motor shaft 43. It comprises a first axis 45, which is arranged parallel to the drive axis 42 and is offset relative thereto by a crank radius r. A push rod 46 that connects the tool carrier 12 and the crank 44 is positioned rotating at one end about the first axis 45. The other end of the push rod 46 is connected to a bearing location 48 of the tool carrier 12 that is provided with a second axis 47. The second axis 47 is positioned parallel to the first axis 45 as well as to the swivel axis 31 of the tool carrier 12. It is advantageous if a balancing weight 49, shown only in FIG. 2, is attached or directly formed onto the crank 44 for the reduction of undesirable vibrations at the crank 44.

It is also conceivable that the first drive motor 40 comprises a motor shaft 43 that projects only on one side from the motor housing and is connected only via a single crankshaft 41 to the tool carrier 12. In that case, the first drive motor 40 should advantageously be arranged in such a way in the machine house 32 that the single crankshaft 41 is connected to the tool carrier approximately in the center of the elongated extension of the tool carrier 12. Further conceivable is that the first drive motor 40 is not arranged directly on the drive axis 43, but operates a drive wheel, arranged on the drive axis 43, via a belt or chain drive or a toothed gear. Also conceivable is that the tool carrier 12 is moved by the first drive motor 40 via a cam drive, not shown herein, from one operating position to the other one. A cam roller that is attached rotating to the second axis 47 of the tool carrier 12 could then roll off a rotating cam disc arranged torque-proof on the drive axis 42 of the first drive motor 40.

The first drive motor 40 and the crankshaft can conceivably also be arranged downstream of the operating position. The bearing location 48 of the tool carrier, indicated in FIG. 2, would then be located on the left side of the tool carrier instead of the right side.

As shown in FIG. 1, the second drive motor 23 of the cutting drum 21 and the first drive motor 40 of the tool carrier 12 are connected to a drive control 61 for exchanging control signals via data lines 60. The third drive motor 11 for the paper web 2 can also be connected via a data line 60 to the drive control 61. The drive control 61 regulates the speed as well as the angle position of the drive motors 11, 23, 40. It is conceivable that a guide signal from the third drive motor 11 can be transmitted to the drive control 61, based on which a first rough positioning of the second drive motor 23 and the first drive motor 40 takes place. A sensor 62 for reading the identification marks 101 affixed to the paper web is optionally arranged upstream of the cutting drum 21 and is focused onto the paper web 2. The drive control 61 can activate the second drive motor 23 and the first drive motor 40 based on the signals from the sensor 62, in such a way that the paper web 2 is precisely perforated or cut at the desired locations. Of course, the drive control 61 can also activate the first drive motor 40 in such a way that the tool carrier 12 is stopped in the rest position.

The inventive method for cutting or perforating a paper web 2 at variable distances is described in the following. With the aid of a digital printing press, not shown in the Figures, differing numbers of individual pages S are printed onto one side or both sides of print sheets 8', 8" on the paper web 2, as mentioned in the above. Following this, the paper web is supplied to the apparatus 1 for the optional cutting and perforating, wherein additional processing stations such as deflecting stations, buffering stations, perforating and cutting devices, cutting and longitudinal folding devices can optionally be arranged between the digital printing press and the inventive apparatus 1. Alternatively, the printed paper web 2 can be rolled up once more following the printing. The printed-on roll can subsequently be transported to an optional location and/or stored. The printed-on paper roll can be supplied as needed to the inventive apparatus 1 for the cutting and perforating, using an unwinding station known from the prior art and additional, above-described optional processing stations.

The paper web 2 is conveyed with a conveying speed v in transport direction T to the apparatus 1, wherein the conveying speed v corresponds to the transporting speed for the paper web in the digital printing press and/or the unwinding station. If the digital paper web 2 is moved through a buffering station, known from the prior art, where a specified length of the paper web 2 can be held back, the conveying speed v can also differ before and after the buffering station. The paper web 2 is transported with the aid of at least one drive mechanism 9, shown in FIG. 1, which transports the web with a single or two counter-rotating drive rollers 10. The drive mechanism 9 can either be embodied as independent station or be part of the digital printing press, respectively the unwinding station, or can be one of the optional processing stations or part of the inventive apparatus 1.

The pages S printed onto the paper web 2 are assigned to individual print sheets 8', 8" having respectively the same or a different number of pages S. In FIG. 1, two first print sheets 8' with respectively four printed pages S, always two pages S on the first side 3 of the paper web 2, and two pages S on the second side 20, are shown on the paper web 2 in upstream direction of the apparatus 1. Downstream of the apparatus 1, a second print sheet 8" with six printed-on pages is shown, which sheet was just cut from the end 102 of the paper web 2 with the cutting tool 16 and the counter tool 25 of the cutting drum 21. Downstream of the print sheet 8", a different print sheet 8' with four pages is shown, which was cut from the paper web 2 ahead of the print sheet 8" and is now being conveyed into the region of the sheet processing stations 80.

The four-page sheets 8' shown in FIG. 1 have a single perforation 73 along which they are folded in a sheet processing station 80 embodied as cross-folding device. The sheets 8' are then supplied via an additional or several optional sheet processing stations 80, for example to a stacking device 6. The sheets 8" with six pages have two perforations 73, along which they are folded while passing through transverse folding devices of the sheet processing station 80. Following this, the folded six-page sheets 8" as well as the four-page sheets 8' are supplied to a stacking device 6 or a different conveying or processing station.

With the inventive method, the continuously conveyed paper web 2, comprising the printed-on sheets 8', 8" with the same or a different number of pages S printed thereon, are optionally either cut or perforated transverse to the transporting direction T. The second drive motor 23 of the cutting drum 21 and the first drive motor 40 that moves the tool carrier 12 are connected for this to the drive control 61. The information relating to the locations for and the spacing with which the paper web 2 must be cut or perforated, is transmitted to the drive control 61, for example by the digital printing press or a super-imposed machine control. As an alternative or in addition thereto, an identification mark 101 that is affixed visibly or non-visibly to the paper web 2 can also be read with the sensor 62. The drive control 61 evaluates the signal from the sensor 62 and determines the location where the paper web 2 is to be cut or perforated.

Figure 7B:
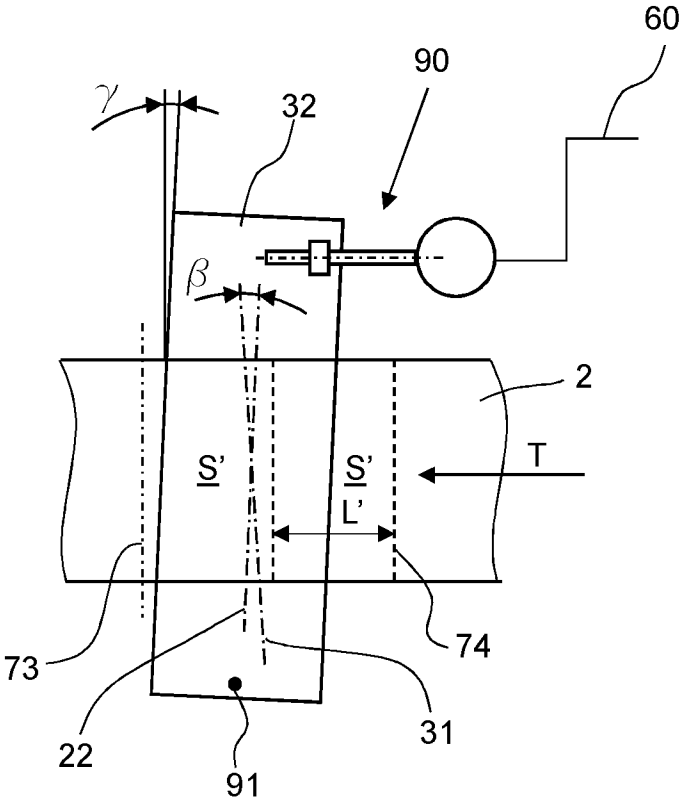
FIG. 7*a, b* Two schematic representations of an inventive apparatus with an adjustment device.
Figure 7A:
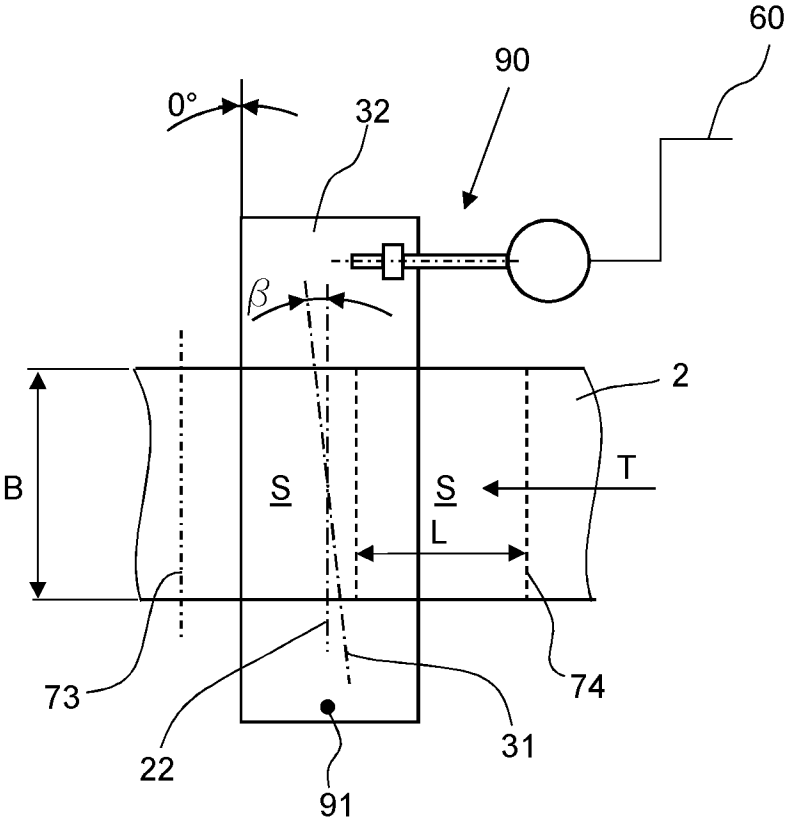

The drive control 61, which can also be integrated into the super-imposed machine control, determines the speed at which the second drive motor 23 drives the cutting drum 21 by using the diameter of the cutting drum 21, the number of counter tools 25 positioned uniformly spaced-apart along the circumference of the cutting drum 21, the conveying speed v of the paper web 2, and the length L of a printed-on page S. The drive control 61 furthermore determines the instant, respectively via the speed and angle position of the second drive motor 23, at which one of the counter tools 25 with its blade 26 must be in the operating position 19, so that the paper web is either perforated or cut at the correct location. If the pages S, printed onto the paper web 2, have the same length L, then the cutting drum 21 rotates uniformly or nearly uniformly at a constant speed for the paper web 2. As shown in FIG. 7*a*, the inventive apparatus with its frame 32 is arranged at a specific angle relative to the paper web 2. The angle referenced as 0° is intended to show that the machine frame 32 is positioned perpendicular to the transporting direction T. If the length L of two adjacent pages S on the paper web 2 differs, the second drive motor 23 accelerates or delays the cutting drum 21, and the circumferential speed of the cutting drum 21 is adapted to a different length L' to produce pages S' as shown in FIG. 7*b*. The length difference is thus compensated and the cut 74 and/or the perforation occur at the intended location. At the same time, the machine frame is turned with the aid of an adjustment device 90 around a fulcrum 91 by an adjustment angle γ, as shown in FIG. 7*b*, so that based on the above-described cutting principle, the processing of the paper web occurs precisely at a right angle to the transporting direction T. If the length L' for a small cutting drum 21 with counter tool 25 is smaller than the circumference of the cutting drum 21 (or is smaller than half the circumference with two counter tools, etc.), the rotational speed and thus the circumferential speed for the cutting drum 21 must be increased. As a result, the scissor cut moving from one edge of the paper web 2 to the other edge occurs within a shorter time interval, meaning the paper web is not transported as far during the shorter interval. The adjustment angle γ is used to compensate for the difference, so that the cut occurs precisely perpendicular to the transporting direction T. The angle β between the axes 22, 31, arranged at a slant to each other, of the cutting drum 21 and/or the tool carrier 12, which is necessary for the scissor cut, represents part of the basic adjustments for the apparatus 1 and is not changed during the operation.

At a constant conveying speed v for the paper web 2 and pages S with the same length L, the cutting drum 21 is driven with a constant or nearly constant rotational speed. It is advantageous if the circumferential speed of the cutting drum 21 is the same or higher than the conveying speed v of the paper web 2, even for pages S with maximum length L. As a result, it is ensured that the paper web 2 does not bunch up at the cutting drum 21 and/or the counter tool 25 since this would impede or make impossible the precise processing through perforating or cutting. It does not matter for the drive of the cutting drum whether the paper web 2 is perforated or cut by the apparatus 1, or if respectively the perforating tool 14 or the cutting tool 16 engage with the counter tool 25 of the cutting drum when in the operating position 19.

The drive control 61 also controls the first drive motor 40 of the tool carrier 12. If a print sheet 8' with four pages S, as shown in FIG. 1, is processed by the apparatus 1 transverse to the movement direction T of the paper web 2, it is alternately cut, then perforated, and subsequently cut once more. The sequence of making a cut 74—a perforation 73—a cut 74—a perforation 73 and the like, is repeated, as long as sheets 8' with four pages S are printed on the paper web 2. If the successively following sheets 8' have pages S of the same length L, the first drive motor 40 can be operated with a constant or nearly constant rotational speed. The tool carrier 12 shown in FIGS. 2, 3, 4 and 5 is swiveled by the first drive motor 40 back and forth around the swivel axis 31 via the crankshaft 41, so that it is swiveled from one of the operating positions 30, 33 around a swivel angle α to the respectively other position. In the first operating position 30, the perforating tool 14 and in the second operating position 33 (see FIG. 3) the cutting tool 16 is in contact with the counter tool 25 of the cutting drum 21, to perforate and/or cut the paper web 2 at the desired location.

The swivel angle α is determined by the spatial arrangement of the first drive 40 relative to the tool carrier 12, by the geometric ratio of the crankshaft, in particular the size of the crank radius r and the length of the push rod 46, by the spacing of the swivel axis 31 and the second rotational axis 47, as well as the arrangement of the swivel axis 31 and the motor shaft 42. In both dead center positions of the crankshaft, in which the drive axis 42, the first axis 45 and the second axis 47 respectively are located in the same plane, the tool carrier 12 is stopped briefly in each of the two operating positions 30, 33. First, this causes the perforating tool 14 and the cutting tool 16 to be respectively stopped while the rotating counter tool 25 engages with one of the two tools. Second, the arrangement is particularly advantageous because the resulting cutting forces generated during the cutting or perforating are for the most part or completely transmitted to the machine frame 32 via the crankshaft, via optional bearing locations of the motor shaft 43 that are not shown in the Figures, and via the first drive motor 40. It is thus easy to prevent an undesirable rotational moment caused by the cutting forces acting upon the first drive motor 40, which would negatively influence the cutting precision, the cutting quality and the service life of the tools 14, 16, 25. The first drive motor 40 furthermore becomes cheaper because it can be dimensioned smaller than would be necessary if it would have to counteract the undesirable rotational moment in order to maintain its most precisely defined position. Of course, the processing of the paper web 2 can occur not only in the above-mentioned dead-center positions of the crankshaft, but also if the drive axis 42, the first axis 45 and the second axis 47 are not yet located or are no longer located in a joint plane. The larger dimensioned first drive motor 40 in that case must compensate a rotational moment resulting from the processing in the form of a stopping moment.

If a sheet 8" with six pages S, shown in FIG. 1, is processed by the inventive apparatus 1 with the inventive method in transverse direction to the movement direction T of the paper web, a cut is first made, followed by two successive perforations, and subsequently followed by another cut. Thus, with several successively printed-on sheets 8" printed onto the paper web 2, this results in a sequence cut 74—perforation 73—perforation 73—cut 74—perforation 73—perforation 73, etc. With this sequence, the tool carrier 12 thus cannot be swiveled back and forth continuously between the operating locations 30, 33 by the continuously rotating or nearly continuously rotating first drive motor 40. If the paper web is perforated twice in succession because of the printed-on sheets 8", the third drive motor 40 is briefly stopped by the drive control 61. The tool carrier 12 stops in the first operating position 30 long enough until two perforations 73 are made on the paper web 2. The first drive motor 40 is then again accelerated, so that the tool carrier 12 and thus the cutting tool 16 is positioned on time in the second operating position 33 for the next processing of the paper web 2 with the counter tool 25.

The arrangement, as shown in FIGS. 1, 2, 3 and 4, which depicts the cutting tool 16 in the left and the perforating tool 14 in the right holding locations 13 of the tool carrier 12 has the advantage that during a change from the first operating location 30 (FIG. 2) to the second operating location 33 (FIG. 3), the paper web is only perforated but not cut. With a movement of the tool carrier 12 counter to the transporting direction T, the end 102 of the paper web 2 could collide then with the tool carrier 12, one of the tools 14, 16, or one of the fastening elements 15, thus causing a paper jam. FIG. 4 shows a situation where the paper web 2 has just been cut between the cutting tool 16 and the counter tool 25. While the tool carrier 12 is pivoted counterclockwise from the second operating position 33 to the first operating position 30, the loose end 102 of the paper web is moved into the transporting device 70. By moving in the same direction, the cutting tool 16 and the perforating tool 14 here support the transport of the end 102 of the paper web 2 in the direction of the transport device 70. The position of the tool carrier shown in FIG. 4 could represent a possible resting position where neither of the two tools 14, 16 is in contact with and the paper web for the processing. In a preferred resting position, the vertical spacing is the same between the blade 17 of the cutting tool 16 and the blade 18 of the perforating tool 14, relative to the paper web.

Figure 6:
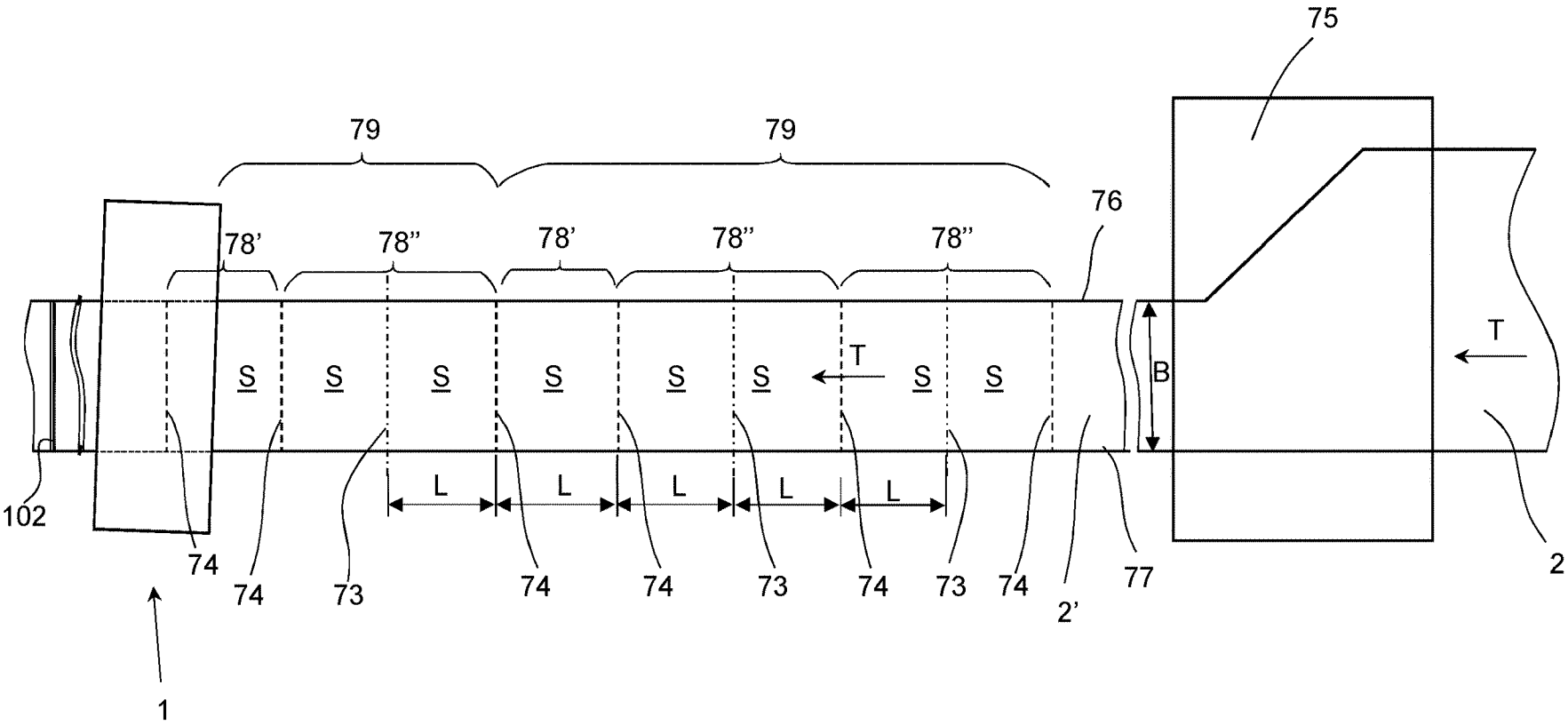
FIG. 6 A schematic representation of a paper web, folded in longitudinal direction prior to the perforating or cutting.

FIG. 6 shows a paper web 2 which, during its transport in conveying direction T, passes through a longitudinal folding device 75, arranged in upstream direction of the inventive apparatus 1 for cutting and perforating. The paper web 2 is folded to half its width B by the longitudinal folding device 75, for example with the aid of a so-called fold former. Following the longitudinal folding device 75, the paper web 2' has two layers. It now has a closed side 76 at the location where it was folded and, on the opposite side an open side 77. The pages S printed onto the paper web 2' are assigned either to first print sheets 78' or second print sheets 78". Since the paper web 2' has two layers, the first print sheet 78' comprises four pages S, wherein only the upper page S is visible. The print sheet 78" accordingly is composed of eight pages S. A plurality of print sheets 78', 78" that are printed in movement direction T successively onto the paper web 2' form a book section 79. Either before or in the above-described stacking device 6, shown in FIG. 1, the sheets 78', 78" of a book section 79 are combined, for example by applying adhesive, and are processed jointly or separately into brochures or books.

Analogous to the above-described method, the four-page print sheets 78' shown in FIG. 6 are cut twice in succession in that the tool carrier 12 stops briefly in the second operating position 33 before being accelerated once more and moved to the first operating position 30. In this first operating position 30, a following print sheet 78" is provided with a perforation 73. With successively following eight-page print sheets 78" having pages S with the same length L, the third drive motor 11 is operated at constant or nearly constant speed. In the process, respectively one perforation 73 and one cut 74 are made for each rotation of the motor shaft 43 of the drive motor 40. If only two-sided sheets 78' are printed successively onto the paper web (not shown herein), then the first drive motor 40 is stopped by the drive control. The tool carrier 12 remains stopped in the second operating position 33 until the last cut 74 is made before a following perforation 73. The first drive motor 40 is then accelerated once more by the drive control 61, so that the tool carrier 12 and thus the perforation tool 14 are positioned on time in the first operating position 33 for the following processing operation of the paper web 2, 2' with the counter tool 25.

Of course, print sheets 8', 8", 78', 78" with pages S having respectively different lengths L can also be processed with the inventive method and the inventive apparatus 1. The drive control 61 correspondingly controls the drive motor 23 for the cutting drum 21, the first drive motor 40 for the tool carrier 12, and the adjustment device 90. Correcting for the length L differences in the pages S respectively occurs by correcting the angle position of the two drive motors 23, 40 between two processing steps, so that each perforation 73 and each cut 74 can be realized at the intended paper web 2, 2' location. Also conceivable is the processing of a paper web 2, 2' with printed-on sheet which has more than 2 perforations. For example, a print sheet composed of eight individual sheets S can be printed onto a single layer paper web 2. Between the steps cuts 74, necessary at the start and at the end of the sheet, three perforations 73 are required for such a print sheet. The eight-page print sheet is respectively folded in half in two transverse folding devices 4, 5 arranged downstream of the apparatus 1. Print sheets with more than 3 perforations 73 transverse to the movement direction T of the paper web 2, 2' can also be realized as long as they can be processed in the downstream arranged processing stations.

With the inventive method and the inventive apparatus 1, paper webs 2, 2' with more than two layers can also be processed, wherein the layers can be connected, for example, via a longitudinal fold or can be placed loosely one above the other and transported jointly.

The print sheets 8', 8", 78', 78", cut from the paper web 2, 2', are transported further downstream of the apparatus 1 in a transporting device 70 that is shown schematically in FIGS. 2, 3 and 4. The upper and lower transport elements 71, 72 of the transport device 70 transport the print sheets 8', 8", 78', 78" with the same or a slightly higher conveying speed v than the speed of the paper web 2, 2'. Owing to the transport of the print sheets 8', 8", 78', 78" in the transport device 70 with the same speed v as that of the paper web 2, 2', no gap forms directly downstream of the apparatus 1 between two print sheets 8', 8", 78', 78". For a transport of the print sheets 8', 8", 78', 78" in the transport device 70 with slightly higher conveying speed, a small gap forms between two print sheets 8', 8", 78', 78". Before the print sheets 8', 8", 78', 78" are cut from the paper web 2, 2' their leading ends at times are already located in the region of the transport device 70 while the trailing ends are still connected to the paper web 2, 2'. The transport speed v of the transport device 70 can be the same or slightly higher than the transport speed v of the paper web 2, 2', so that the paper web 2, 2' in the inventive apparatus maintains the path tension and is not bunched up. The print sheets 8', 8", 78', 78" are positioned in the transport device 70 either on lower transport elements 71 or between the lower transport elements 71 and the upper transport elements 72.

If the paper web 2, 2' is not processed, for example during the operational setup, the tool carrier 12 is stopped in a rest position, e.g. between the operating positions 30, 33. The rest position could look as shown in FIG. 4 where neither the perforating tool 14 nor the cutting tool 16 are engaged with the counter tool 25. The blades 17, 18 belonging to the perforating tool 14 and the cutting tool 16 are positioned at a distance in horizontal direction from the paper web 2, 2' and at a distance in horizontal and vertical direction from the operating position 19. The cutting drum 21 can also be stopped or can continue to rotate at a reduced or the same speed relative to the paper web 2, 2'.

It will be understood that the above description of the present invention is susceptible to various modifications, changes and adaptations, and that the same are intended to be comprehended within the meaning and range of equivalents of the appended claims.

What is claimed is:

1. An apparatus for processing a paper web, digitally printed-on and moved continuously through the apparatus in a movement direction, said apparatus comprising:

a perforating tool for perforating the paper web transverse to the movement direction;

a cutting tool for cutting off print sheets from a downstream end of the paper web, wherein the perforating tool and the cutting tool are respectively arranged on a first side of the paper web and transverse to the movement direction of the paper web;

at least one counter tool arranged on a side that is opposite the first side of the paper web;

a rotatable cutting drum for holding the at least one counter tool, the drum including a rotational axis which is oriented transverse to the movement direction of the paper web;

a joint tool carrier for accommodating the perforating tool and the cutting tool, wherein the perforating tool and the cutting tool are attached spaced-apart on the tool carrier, and wherein the tool carrier is movable between two operating positions in which the perforating tool is made to engage with the at least one counter tool in one of the two operating positions for processing the paper web and the cutting tool is made to engage with the at least one counter tool in the other of the two operating positions for processing the paper web;

a first drive motor having a drive shaft having a drive axis; and a crankshaft connecting the tool carrier to the drive shaft of the first drive motor to realize a swivel movement of the tool carrier;

wherein the crankshaft includes a crank arranged on the drive shaft of the first drive motor and a push rod having a first connection to the crank that defines a first axis and having a second connection to the tool carrier that defines a second axis.

2. The apparatus according to claim 1, wherein the wherein the swivel movement of the tool carrier comprises a swivel back and forth by a swivel angle between the two operating positions around a swivel axis which is positioned transverse to the movement direction of the paper web and parallel to a transport plane for the paper web, so that either the perforating tool or the cutting tool engage with the at least one counter tool.

3. The apparatus according to claim 2, wherein the perforating tool comprises a perforating blade and the cutting tool comprises a cutting blade, and the rotational axis of the cutting drum and the swivel axis of the tool carrier, as both projected onto a plane that is parallel to the transport plane, are arranged relative to each other so that, based on a scissor-cutting principle, the perforating blade or the cutting blade, respectively, comes in contact only over a partial region along its length with the at least one counter tool.

4. The apparatus according to claim 1, wherein the first drive motor comprises a gearless torque motor.

5. The apparatus according to claim 1, wherein the first axis, the second axis and the drive axis of the drive shaft of the first drive motor are arranged parallel to each other and the first axis and the drive axis are positioned spaced-apart by a crank radius.

6. The apparatus according to claim 1, wherein the first axis, the second axis and the drive axis of the drive shaft of the first drive motor are respectively arranged in a single plane when the tool carrier is in each of the two operating positions.

7. The apparatus according to claim 1, wherein the tool carrier is movable to a rest position between the two operating positions in which neither the perforating tool nor the cutting tool engages with the counter tool.

8. The apparatus according to claim 1, further comprising a joint machine frame, wherein at least the cutting drum, the tool carrier and the first drive motor are fixed to the joint machine frame.

9. A method for processing a digitally printed paper web utilizing the apparatus of claim 1, comprising:

transporting the paper web continuously in the movement direction through the apparatus;

rotating the at least one counter tool around the rotational axis; and selectively moving the tool carrier that mounts the perforating tool and the cutting tool between the two operating positions for processing the paper web so that the perforating tool cooperates with the at least one counter tool in the one of the two operating positions to perforate the paper web transverse to the movement direction and the cutting tool cooperates with the at least one counter tool in the other of the two operating positions to cut the print sheets from the downstream end of the paper web.

10. The method according to claim 9, further including swiveling the joint tool carrier by an angle between the two operating positions around a swivel axis, the swivel axis arranged transverse to the movement direction of the paper web and parallel to a transport plane for the paper web; and engaging, in each of the two operating positions, either the perforating tool or the cutting tool with the at least one counter tool to perforate or cut the paper web.

11. The method according to claim 9, comprising moving the tool carrier to a rest position between the two operating positions in which neither the cutting tool nor the perforating tool engages with the at least one counter tool and the paper web is not processed.

12. The method according to claim 9, comprising: alternately perforating the paper web by the perforating tool and cutting the paper web with the cutting tool; and rotating the first drive motor, that is connected via the crankshaft to the tool carrier, with a constant rotational speed.

13. The method according to claim 12, comprising stopping and maintaining the tool carrier in either of the two operating positions to thereby realize several successively following, identical processing operations for the paper web.

14. The method according to claim 13, comprising starting the first drive motor rotating following the several successively following, identical processing operations for the paper web to move the tool carrier from the one operating position to the other operating position.

15. The method according to claim 9, comprising:

activating, with a drive control, the first drive motor for the tool carrier, a second drive motor for the cutting drum and a third drive motor for a paper web transport for the transporting of the paper web.

16. The method according to claim 15, comprising: evaluating signals in the drive control from a sensor directed toward the paper web; and using an evaluation of the signals to influence activation of the first, second and third drive motors.

17. The method according to claim 9, comprising jointly swiveling at least the perforating tool, the cutting tool and the counter tool relative to the paper web, parallel to a transport plane of the paper web.

18. An apparatus for processing a paper web, digitally printed-on and moved continuously through the apparatus in a movement direction, said apparatus comprising:

a perforating tool for perforating the paper web transverse to the movement direction;

a cutting tool for cutting off print sheets from a downstream end of the paper web, wherein the perforating tool and the cutting tool are respectively arranged on a first side of the paper web and transverse to the movement direction of the paper web;

at least one counter tool arranged on a side that is opposite the first side of the paper web;

a rotatable cutting drum for holding the at least one counter tool, the drum including a rotational axis which is oriented transverse to the movement direction of the paper web;

a joint tool carrier for accommodating the perforating tool and the cutting tool, wherein the perforating tool and the cutting tool are attached spaced-apart on the tool carrier, and wherein the tool carrier is movable between two operating positions in which the perforating tool is made to engage with the at least one counter tool in one of the two operating positions for processing the paper web and the cutting tool is made to engage with the at least one counter tool in the other of the two operating positions for processing the paper web;

a first drive motor having a drive shaft having a drive axis;

a crankshaft connecting the tool carrier to the drive shaft of the first drive motor to realize a swivel movement of the tool carrier;

a second drive motor to drive the cutting drum with the at least one counter tool;

a drive control connected to the second drive motor for controlling a speed and an angular position of the second drive motor;

a joint machine frame, wherein at least the cutting drum, the tool carrier and the first drive motor are positioned in the joint machine frame; and an adjustment device, wherein the machine frame has a fulcrum and the machine frame is arranged to be swiveled with the adjustment device relative to the paper web around the fulcrum parallel to the transport plane of the paper web.

19. The apparatus according to claim 18, comprising a drive mechanism including a third drive motor for transporting the paper web, wherein the first drive motor and the third drive motor are connected to the drive control.

20. The apparatus according to claim 18, further comprising a sensor arranged upstream of the cutting drum and connected to the drive control for detecting an identification mark affixed to the paper web.

* * * * *